US012324517B2

(12) United States Patent
Choi

(10) Patent No.: US 12,324,517 B2
(45) Date of Patent: Jun. 10, 2025

(54) FOLDABLE TABLE WITH LEG ROTATION LIMITING STRUCTURE

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 91 days.

(21) Appl. No.: 18/353,774

(22) Filed: Jul. 17, 2023

(65) Prior Publication Data

US 2024/0057759 A1 Feb. 22, 2024

(30) Foreign Application Priority Data

Aug. 18, 2022 (CN) ..... 202222174819.2

(51) Int. Cl.
*A47B 9/14* (2006.01)
*A47B 3/08* (2006.01)

(52) U.S. Cl.
CPC ..... *A47B 9/14* (2013.01); *A47B 2003/0806* (2013.01)

(58) Field of Classification Search
CPC . A47B 3/0803; A47B 2003/0806; A47B 9/14; A47B 2200/0052; A47B 2200/0085
See application file for complete search history.

(56) References Cited

U.S. PATENT DOCUMENTS

| | | | | |
|---|---|---|---|---|
| 4,196,675 A * | 4/1980 | Cook | A47B 3/0818 108/6 |
| 5,383,411 A * | 1/1995 | Tomaka | A47B 23/001 108/132 |
| 5,417,168 A * | 5/1995 | Soper | A47B 3/0918 108/6 |
| 2005/0057128 A1* | 3/2005 | Anderson | A47B 47/042 312/257.1 |
| 2012/0227637 A1* | 9/2012 | Meadows | F16M 13/022 108/50.11 |
| 2021/0062842 A1* | 3/2021 | Chen | A47B 9/16 |

* cited by examiner

*Primary Examiner* — Matthew W Ing
(74) *Attorney, Agent, or Firm* — MORGAN, LEWIS & BOCKIUS LLP

(57) ABSTRACT

A table includes a tabletop, a first support assembly, first and second legs, and first and second limiting structures. The first support assembly is connected to the tabletop such that the tabletop is rotatable with respect to the first support assembly around a first axis between folded and unfolded positions. The first leg is connected to the first support assembly and rotatable around a second axis substantially perpendicular to the first axis. The first limiting structure is disposed at or integrally formed with the first leg to limit rotation of the first leg between first closed and open positions. The second leg is connected to the first support assembly and rotatable around a third axis substantially perpendicular to the first axis. The second limiting structure is disposed at or integrally formed with the second leg to limit rotation of the second leg between second closed and open positions.

19 Claims, 9 Drawing Sheets

FOLDABLE TABLE WITH LEG ROTATION LIMITING STRUCTURE

CROSS-REFERENCE TO RELATED APPLICATIONS

The present application claims priority to Chinese Utility Model Application CN 202222174819.2 filed Aug. 18, 2022. The disclosure of the application is incorporated herein for all purposes by reference in its entirety.

FIELD OF THE INVENTION

The present invention generally relates to tables, and more particularly, to foldable tables.

BACKGROUND

Foldable tables are popular due to their ease of use and transport. They are often used in exhibitions, conferences and other places. They have become an integral part of home furniture.

However, legs of some existing foldable tables can rotate 360° with no restrictions. Such a table is not stable. For instance, when a small force is applied to a side of the table in use, legs may deviate from their unfolded positions causing the table to tip, vibrate or collapse.

Given the current state of the art, there remains a need for foldable tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides foldable tables having structures to limit leg rotations.

In various exemplary embodiments, the present invention provides a foldable table including a tabletop, a first support assembly, a first leg and a second leg. The first support assembly is connected to the tabletop such that the tabletop is rotatable with respect to the first support assembly around a first axis between a folded position and an unfolded position. The first leg is connected to the first support assembly and rotatable around a second axis substantially perpendicular to the first axis between a first closed position and a first open position. The second leg is connected to the first support assembly and rotatable around a third axis substantially perpendicular to the first axis between a second closed position and a second open position. The table is folded when the tabletop is in the folded position, the first leg is in the first closed position, and the second leg is in the second closed position. The table is unfolded when the tabletop is in the unfolded position, the first leg is in the first open position, and the second leg is in the second open position.

In some exemplary embodiments, the first support assembly includes a first support and a second support. The first leg is rotatably connected to the first support, and the second leg is rotatably connected to the second support. A first limiting structure is disposed at or integrally formed with one of the first support and first leg to limit rotation of the first leg relative to the first support within the first closed position and first open position. A second limiting structure is disposed at or integrally formed with one of the second support and second leg to limit rotation of the second leg relative to the second support within the second closed position and second open position.

In some exemplary embodiments, a respective limiting structure in the first and second limiting structures is hollow and includes a protrusion on an interior surface of the respective limiting structure. In some such embodiments, the protrusion includes a first limiting surface and a second limiting surface. A corresponding support in the first and second supports or a corresponding leg in the first and second legs includes a first exterior surface. The first exterior surface of the corresponding support or corresponding leg abutting against the first and second limiting surfaces of the protrusion of the respective limiting structure defines corresponding closed and open positions of the corresponding leg.

In some exemplary embodiments, the respective limiting structure is a sleeve fixed at an upper end portion of the corresponding leg.

In some exemplary embodiments, the first and second limiting surfaces of the respective limiting structure are substantially perpendicular to each other.

In some exemplary embodiments, the first exterior surface of the corresponding support or corresponding leg is substantially flat.

In some exemplary embodiments, the corresponding support or corresponding leg includes a second exterior surface, wherein the second exterior surface is an arc surface.

In some exemplary embodiments, the corresponding support or corresponding leg has a substantially D-shaped cross-section.

In some exemplary embodiments, the first support is elongated along the second axis, and the second support is elongated along the third axis. In some such embodiments, a respective leg in the first and second legs is movable along a corresponding support in the first and second supports and selectively lockable at any one of a plurality of heights relative to the corresponding support. In some exemplary embodiments, one of the respective leg or the corresponding support includes a plurality of positioning holes along a length direction of the respective leg or the corresponding support, and the other of the respective leg or the corresponding support includes a clamping element insertable into any one of the plurality of positioning holes.

In some exemplary embodiments, each of the first and second legs includes a first segment and a second segment collectively forming a substantially L shape. In some such embodiments, the second segments of the first and second legs are folded onto each other when the first leg is in the first closed position and the second leg is in the second closed position. In some such embodiments, the second segments of the first and second legs are spaced apart and substantially parallel to each other when the first leg is in the first open position and the second leg is in the second open position. In some such embodiments, the table includes an accessory member connected to the second segments of the first and second legs to help prevent the first or second leg from rotating around the second or third axis when the table is in use. The accessory member is removably connected to the second segment of the first or second leg.

In some exemplary embodiments, the first support assembly further includes a lateral support between the first and second supports and rotatably connected to the tabletop at or adjacent to an edge of the tabletop.

In some exemplary embodiments, the table further includes a second support assembly connected to the tabletop and the first support assembly to define the unfolded position of the tabletop with respective to the first support assembly. In some such embodiments, the tabletop includes a plurality of slots on an underside of the tabletop, and the second support assembly is selectively and removably connected to any one of the plurality of slots, thereby defining a plurality of unfolded positions of the tabletop with respective to the first support assembly.

In some exemplary embodiments, the table further includes an accessory assembly slidably connected to the tabletop and movable between an extended position and a contracted position with respect to the tabletop.

In various exemplary embodiments, the present invention provides a foldable table including a tabletop, a first support assembly, a first leg, a second leg, a first limiting structure and a second limiting structure. The first support assembly is connected to the tabletop such that the tabletop is rotatable with respect to the first support assembly around a first axis between a folded position and an unfolded position. The first leg is connected to the first support assembly and rotatable around a second axis substantially perpendicular to the first axis. The first limiting structure is disposed at or integrally formed with the first leg to limit rotation of the first leg between a first closed position and a first open position. The second leg is connected to the first support assembly and rotatable around a third axis substantially perpendicular to the first axis. The second limiting structure is disposed at or integrally formed with the second leg to limit rotation of the second leg between a second closed position and a second open position. Each of the first and second legs includes a first segment and a second segment collectively forming a substantially L shape.

The foldable tables of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

Figure 1:
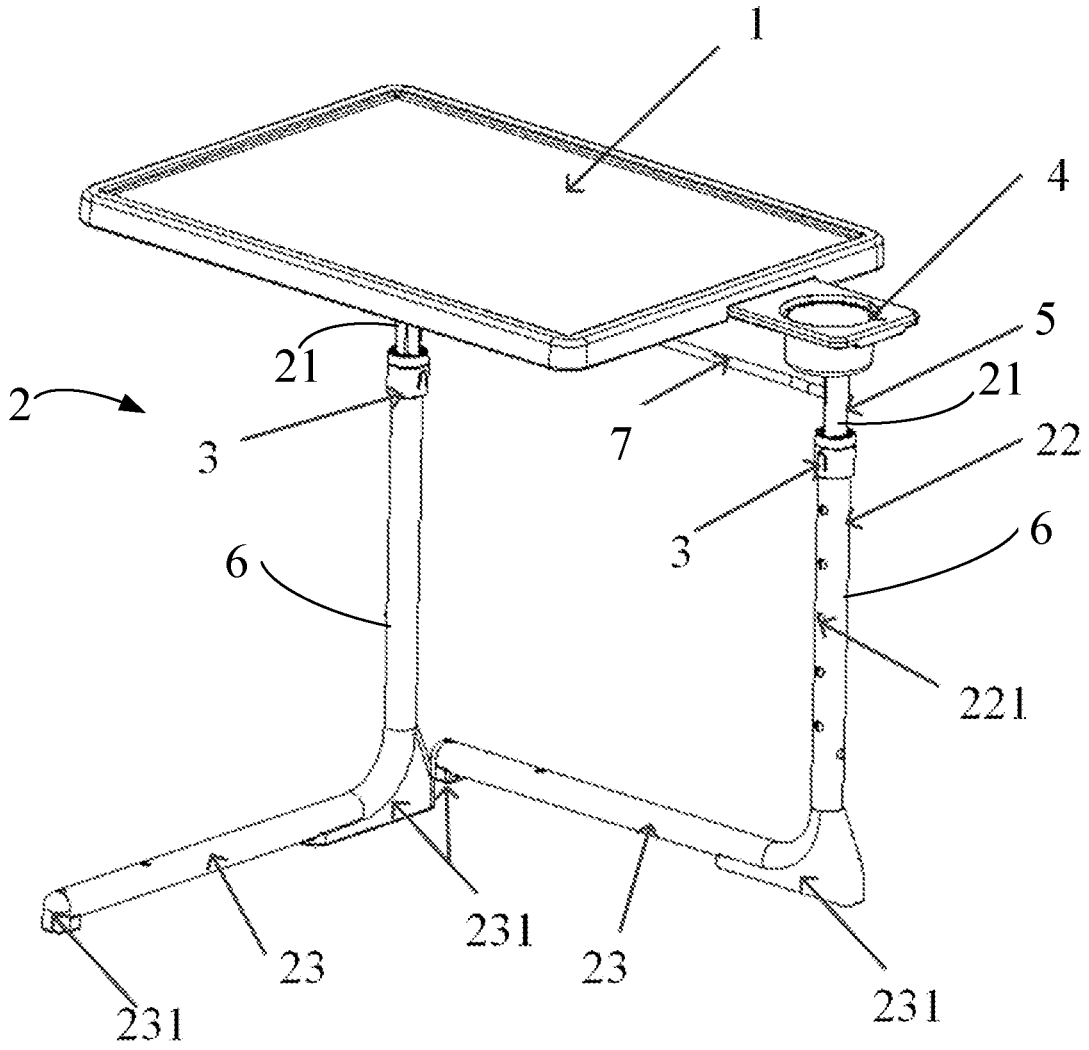
FIG. 1 is a perspective view illustrating an exemplary table in a first state in accordance with some exemplary embodiments of the present invention.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only.

Embodiments of the present invention are described in the context of a table having a tabletop and a table frame to support the tabletop. A table frame generally includes a first support assembly connected to the tabletop so that the tabletop is rotatable relative to the first support assembly around a first axis. This allows the tabletop to fold onto the table frame. The table frame also includes one or more legs, each connected to the first support assembly and rotatable within a limited range around an axis that is substantially perpendicular to the first axis. This allows the one or more legs to fold onto each other while ensuring the stability of the table when unfolded. In some exemplary embodiments, the table frame further includes a second support assembly connected to the tabletop and the first support assembly to define one or more unfolded positions of the tabletop with respective to the first support assembly.

A table of the present disclosure can be of various sizes. For instance, a table of the present disclosure can be a coffee table, a dining table, a picnic table or the like. The tabletop can be of various shapes including but not limited to a square shape, a round shape or a rectangular shape, and can be made of various materials including, but not limited to, plastics and woods. In some exemplary embodiments, the tabletop includes a table panel made of plastics by injection molding, blow molding or any other suitable processes. The table frame of the present disclosure can be made of various materials including but not limited to metals (e.g., iron, steel, and aluminum), plastics and woods.

Referring now to FIGS. 1-7, there is depicted an exemplary table 100 in accordance with some embodiments of the present disclosure. In various exemplary embodiments, table 100 includes a tabletop, such as tabletop 1. While tabletop 1 is of a rectangular shape in the figures, it should be noted that tabletop 1 can be of any suitable shapes including but not limited to rectangular, square, round, oval, oblong or the like.

Figure 4:
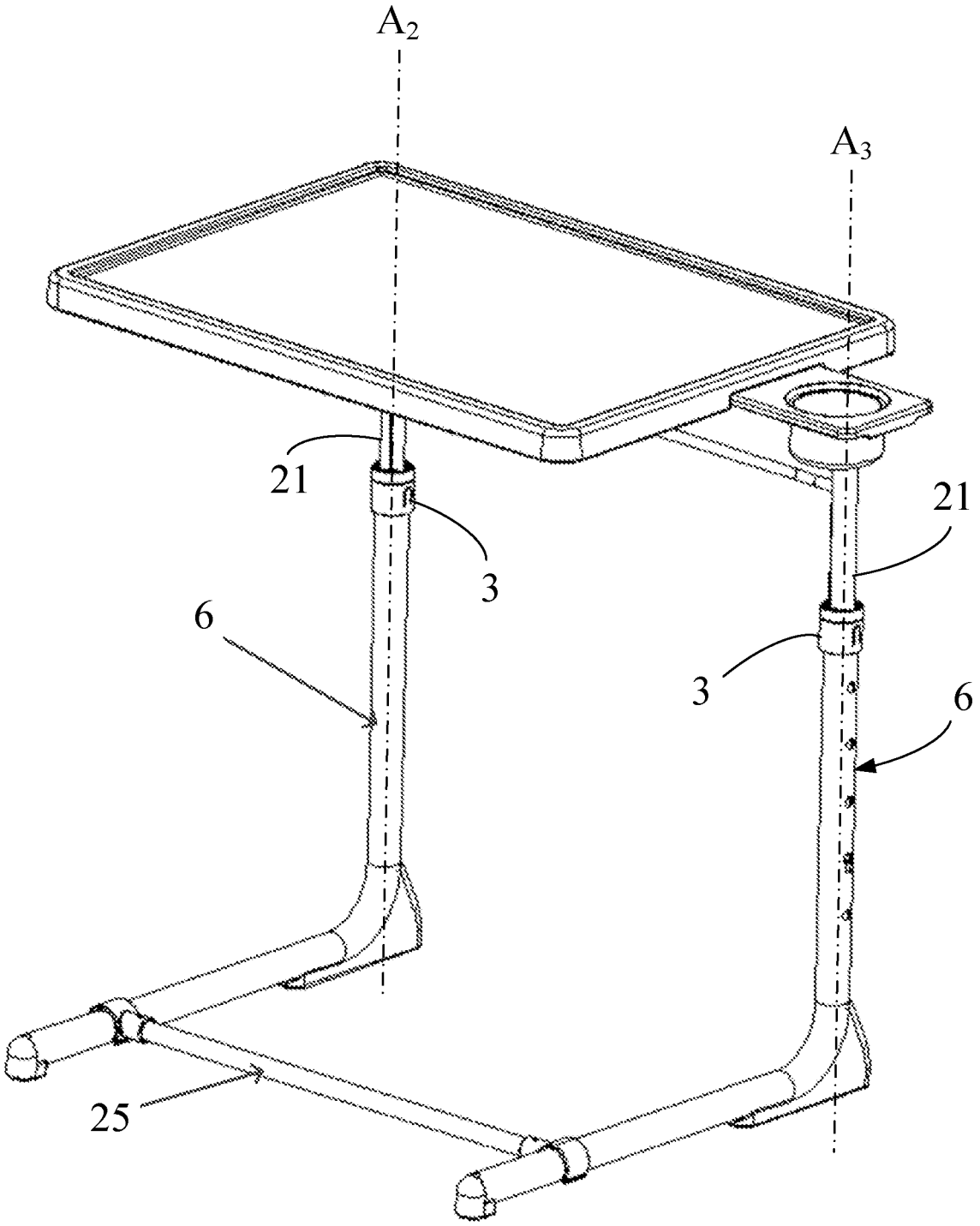
FIG. 4 is a perspective view illustrating the exemplary table of FIG. 1 in a second state in accordance with some exemplary embodiments of the present invention.
Figure 5:
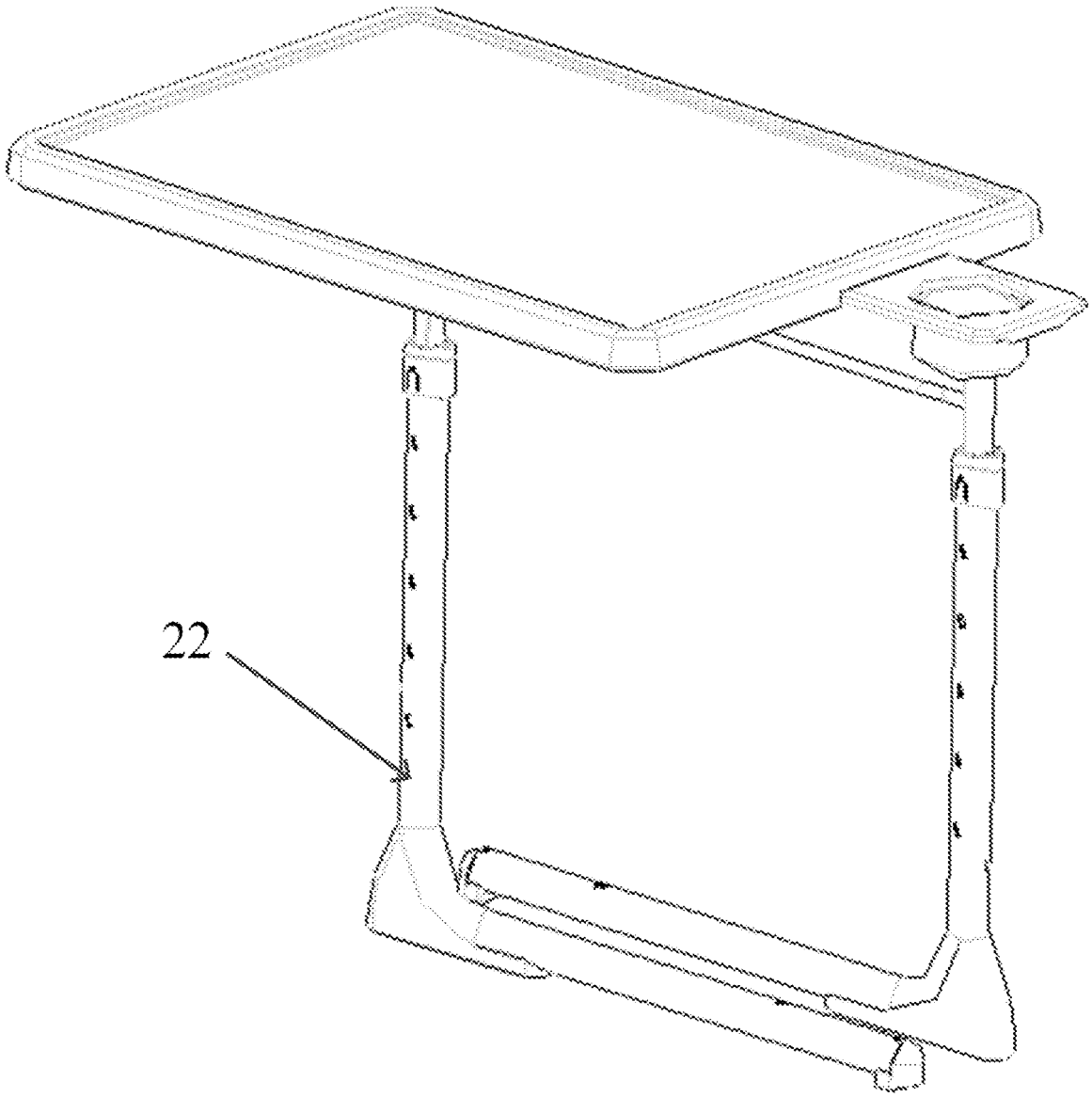
FIG. 5 is a perspective view illustrating the exemplary table of FIG. 1 in a third state in accordance with some exemplary embodiments of the present invention.
Figure 6:
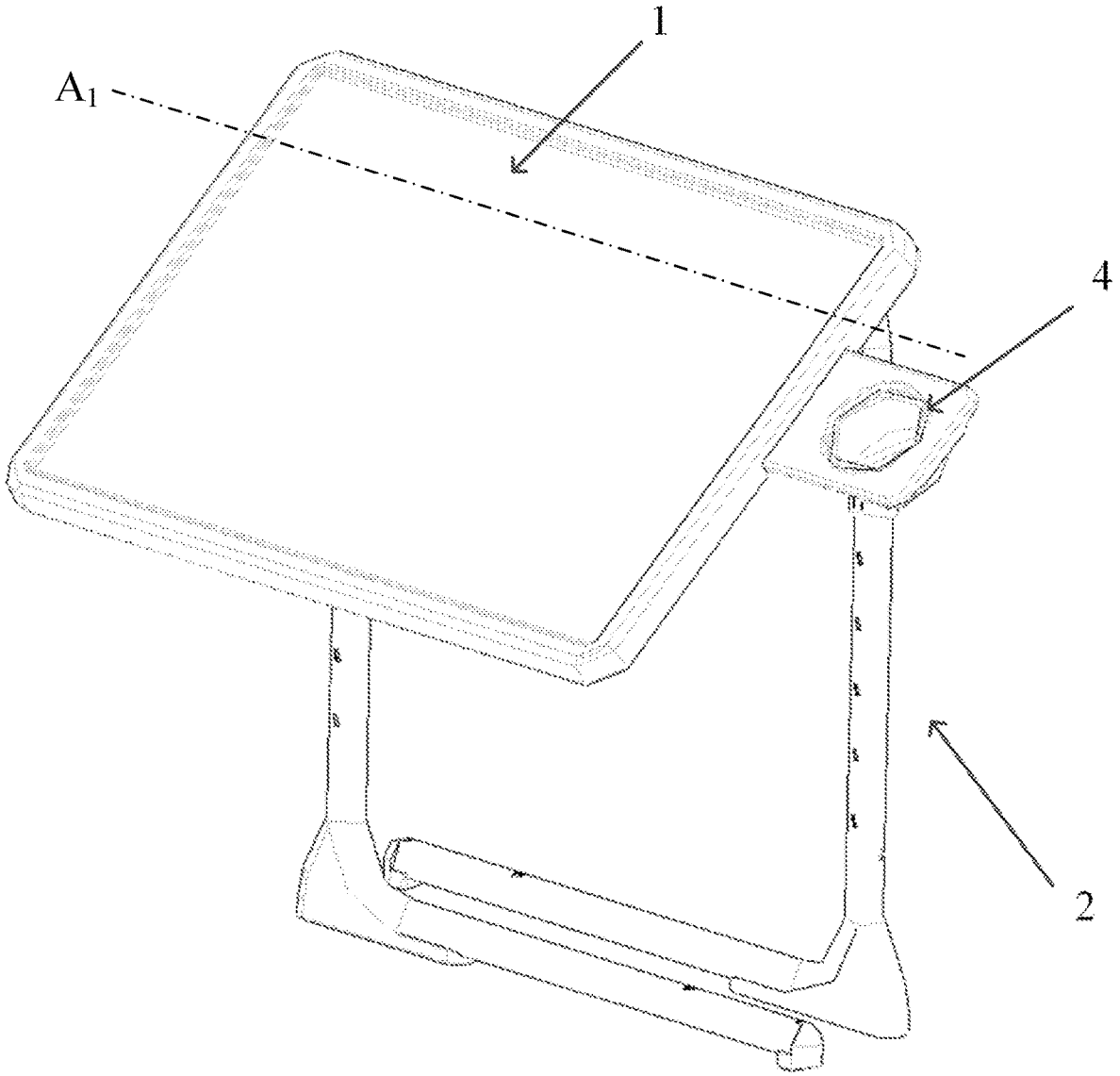
FIG. 6 is a perspective view illustrating the exemplary table of FIG. 1 in a fourth state in accordance with some exemplary embodiments of the present invention.
Figure 7:
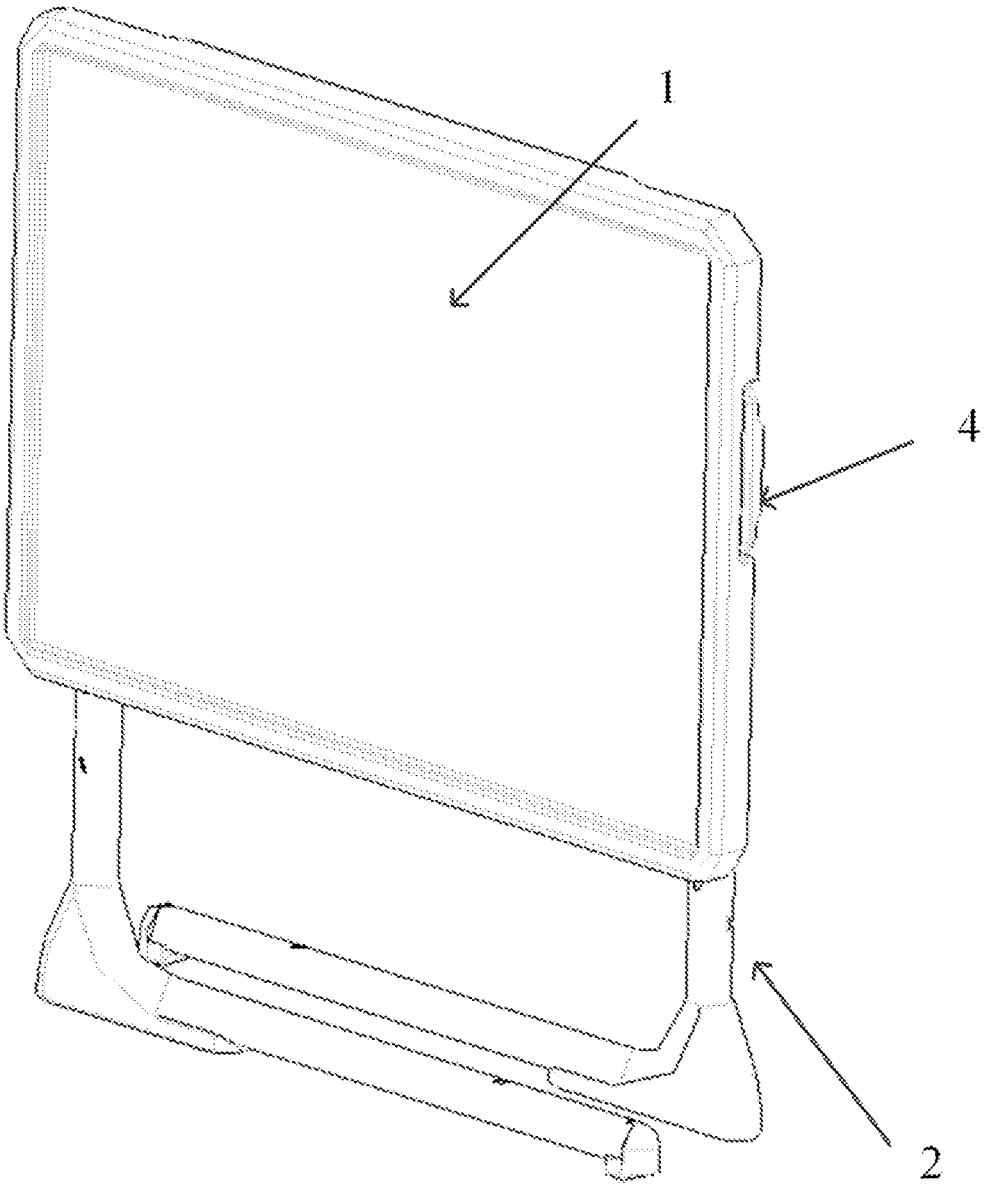
FIG. 7 is a perspective view illustrating the exemplary table of FIG. 1 in a fifth state in accordance with some exemplary embodiments of the present invention.

Table 100 also includes a table frame, such as table frame 2. The table frame is coupled with the tabletop and supports the tabletop when in use. In various exemplary embodiments, table frame 2 includes a first support assembly, such as first support assembly 5. The first support assembly is connected to the tabletop such that the tabletop is rotatable with respect to the first support assembly around a first axis between a folded position and an unfolded position. For instance, as a non-limiting example, FIG. 6 illustrates that tabletop 1 is rotatable with respect to first support assembly 5 around axis $A_1$, FIGS. 1, 4 and 5 illustrate that tabletop 1 is in an unfolded position and FIG. 7 illustrates that tabletop 1 is in a folded position.

In some exemplary embodiments, the first support assembly includes a first support (e.g., support 21 on the left side of FIG. 1) and a second support (e.g., support 21 on the right side of FIG. 1). The first and second supports can be but do not have to identical or symmetric to each other. As a non-limiting example, it is illustrated that the first and second supports are substantially the same and/or symmetric. In some exemplary embodiments, each of the first and second supports is an elongated piece. For instance, as a non-limiting example, FIG. 4 illustrates that the first support (e.g., support 21 on the left side of FIG. 4) is elongated along axis $A_2$ and the second support (e.g., support 21 on the right side of FIG. 4) is elongated along axis $A_3$.

In various exemplary embodiments, table frame 2 also includes one or more legs connected to the first support assembly. For instance, in some exemplary embodiments, table frame 2 includes a first leg (e.g., leg 6 on the left side of FIG. 1) and a second leg (e.g., leg 6 on the right side FIG. 1). The first and second legs can be but do not have to identical or symmetric to each other. As a non-limiting example, it is illustrated that the first and second legs are substantially the same and/or symmetric. In some exemplary embodiments, at least one of the first and second legs is composed of multiple segments. For instance, in the illustrated embodiment, each of the first and second legs includes first segment 22 and second segment 23, which collectively form a substantially L shape with first segment 22 connected to the first support assembly and second segment 23 configured to be placed on the ground.

In some exemplary embodiments, the first leg (e.g., leg 6 on the left side of FIG. 4) is connected to the first support (e.g., support 21 on the left side of FIG. 4) of the first support assembly and rotatable around axis $A_2$. The rotation of the first leg is restrained within a limited range, e.g., between a first closed position as illustrated in FIG. 5 and a first open position as illustrated in FIG. 4. Similarly, the second leg (e.g., leg 6 on the right side of FIG. 4) is connected to the second support (e.g., support 21 on the right side of FIG. 4) of the first support assembly and rotatable around axis $A_3$. The rotation of the second leg is restrained within a limited range, e.g., between a second closed position as illustrated in FIG. 5 and a second open position as illustrated in FIG. 4. Generally, axis $A_2$ and axis $A_3$ are each substantially perpendicular to axis $A_1$. In some exemplary embodiments, when the first leg is in the first open position and the second leg is in the second open position, the second segments of the first and second legs are spaced apart and substantially parallel to each other as illustrated in FIG. 4. In some embodiments, when the first leg is in the first closed position and the second leg is in the second closed position, the second segments of the first and second legs are folded onto each other as illustrated in FIG. 5.

In some exemplary embodiments, table frame 2 includes one or more limiting structures to restrain the rotation of the first leg and/or second leg within a desired range, e.g., between an open position and a closed position. For instance, in some exemplary embodiments, table frame 2 includes a first limiting structure to restrain the rotation of the first leg and a second limiting structure to restrain the rotation of the second leg. The first and second limiting structures can be but do not have to be identical. Also, the first limiting structure can be disposed at or integrally formed with the first support or the first leg, and the second limiting structure can be disposed at or integrally formed with the second support or the second leg. As a non-limiting example, it is illustrated that the first limiting structure (e.g., limiting structure 3 on the left side of FIG. 1) is disposed at or integrally formed with the first leg (e.g., leg 6 on the left side of FIG. 1) and the second limiting structure (e.g., limiting structure 3 on the right side of FIG. 1) is disposed at or integrally formed with the second leg (e.g., leg 6 on the right side of FIG. 1).

Figure 2:
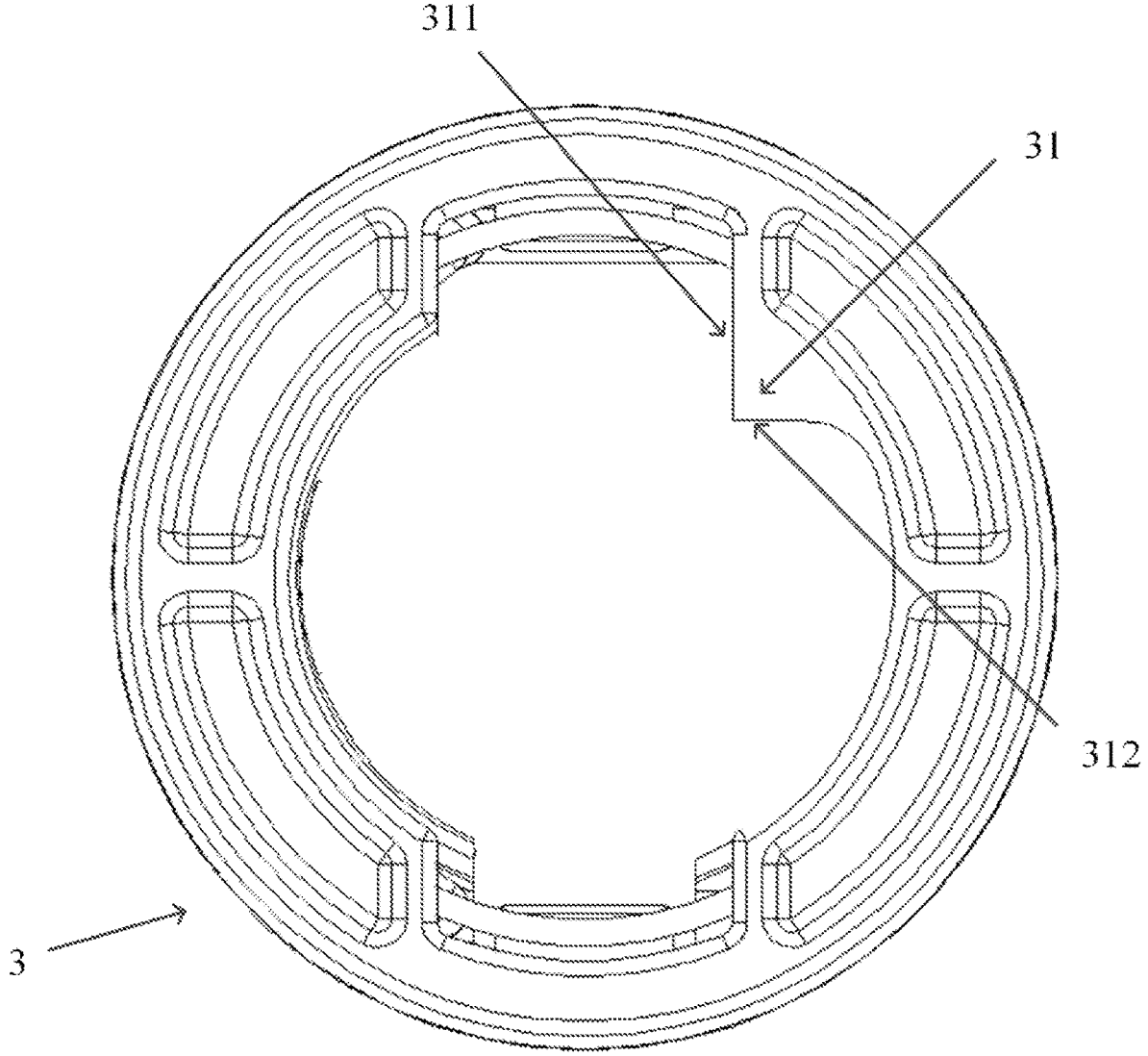
FIG. 2 is a top view illustrating a component of the exemplary table of FIG. 1 in accordance with some exemplary embodiments of the present invention.
Figure 3:
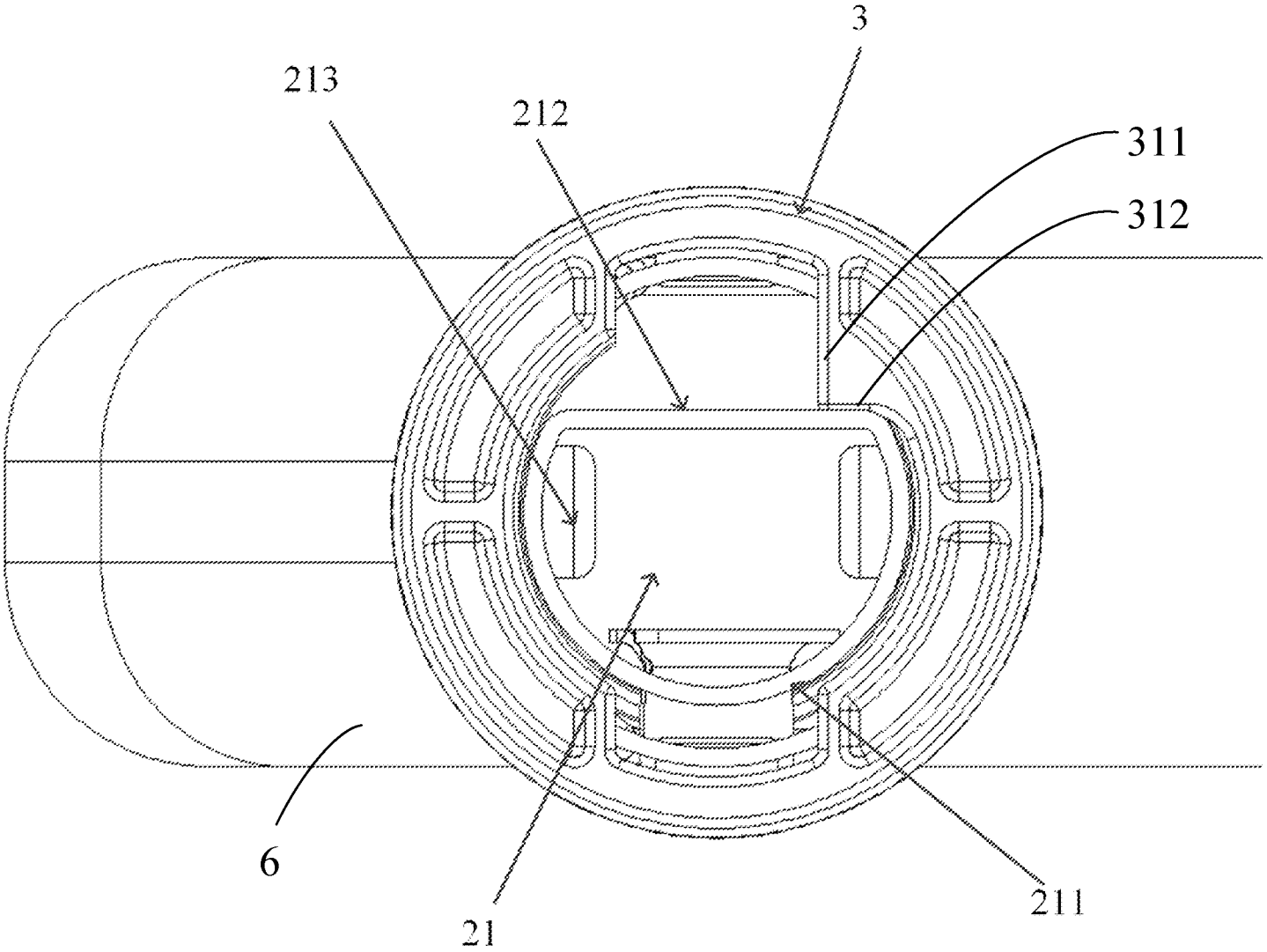
FIG. 3 is a top view illustrating some components of the exemplary table of FIG. 1 in accordance with some exemplary embodiments of the present invention.

Referring in particular to FIGS. 1-3, in some exemplary embodiments, limiting structure 3 is hollow. For instance, in some exemplary embodiments, limiting structure 3 is a sleeve or the like that is fixed at an upper end portion of leg 6 (e.g., an upper end portion of first segment 22 of leg 6). Limiting structure 3 and leg 6 receives at least a portion of support 21. In some exemplary embodiments, limiting structure 3 includes a protrusion, such as protrusion 31, on its interior surface. In some exemplary embodiments, the protrusion is integrally formed on the limiting structure. In some exemplary embodiments, the protrusion extends radially inward from the interior surface of the limiting structure. In some exemplary embodiments, protrusion 31 includes limiting surface 311 and limiting surface 312. In some exemplary embodiments, limiting surface 311 and limiting surface 312 are substantially flat and parallel to axis $A_2$ or $A_3$. In some exemplary embodiments, limiting surface 311 and limiting surface 312 are substantially perpendicular to each other. However, the present invention is not limited thereto. For instance, limiting surface 311 and limiting surface 312 do not have to be perpendicular to each other.

In some exemplary embodiments, support 21 includes one or more exterior surfaces. For instance, in some exemplary embodiments, support 21 include exterior surface 211 and exterior surface 212. In some exemplary embodiments, support 21 has a substantially D-shaped cross-section, e.g., exterior surface 211 being an arc surface and exterior surface 212 being substantially flat. However, the present invention is not limited thereto. Exterior surface 211 does not have to be arched and exterior surface 212 does not have to be flat.

As illustrated in FIG. 3, when exterior surface 212 of support 21 abuts against limiting surface 312 of limiting structure 3, leg 6 is allowed to rotate counterclockwise but is not allowed to rotate clockwise. When exterior surface 212 of support 21 abuts against limiting surface 311 of limiting structure 3, leg 6 is allowed to rotate clockwise but is not allowed to rotate counterclockwise. As such, rotation of leg 6 is restrained within a range, i.e., between a desired closed position and a desired open position. In embodiments where exterior surface 212 of support 21 is substantially flat and limiting surfaces 311 and 312 of limiting structure 3 are substantially perpendicular to each other, rotation of leg 6 is limited to between 0° and 90°.

In some exemplary embodiments, table 100 includes an accessory member, such as accessory member 25. The accessory member is configured to be connected to the second segments of the first and second legs to help prevent the first leg from rotating around axis $A_2$ and/or prevent the second leg from rotating around axis $A_3$ when the table is in use. As such, the accessory member enhances the stability of the table. In some exemplary embodiments, the accessory member is removably connected to the second segment of the first leg, the second segment of the second leg, or both.

In some exemplary embodiments, the table is folded when the tabletop is in the folded position, the first leg is in the first closed position, and the second leg is in the second closed position as illustrated in FIG. 7. The table is unfolded when the tabletop is in the unfolded position, the first leg is in the first open position, and the second leg is in the second open position as illustrated in FIG. 4 (with or without accessory member 25 disclosed elsewhere herein).

In some exemplary embodiments, leg 6 includes one or more base elements, such as base element 231, disposed at second segment 23 of the leg. In some exemplary embodiments, leg 6 includes one base element disposed at each end portion of second segment 23 of the leg. In some exemplary embodiments, base element 231 is made of plastic, rubber or similar materials. In some exemplary embodiments, base element 231 is configured to protect the leg (e.g., reduce wear), increase the friction with the ground, enhance the stability of the table while in use, extend the life of the table, or any combination thereof.

Figure 8:
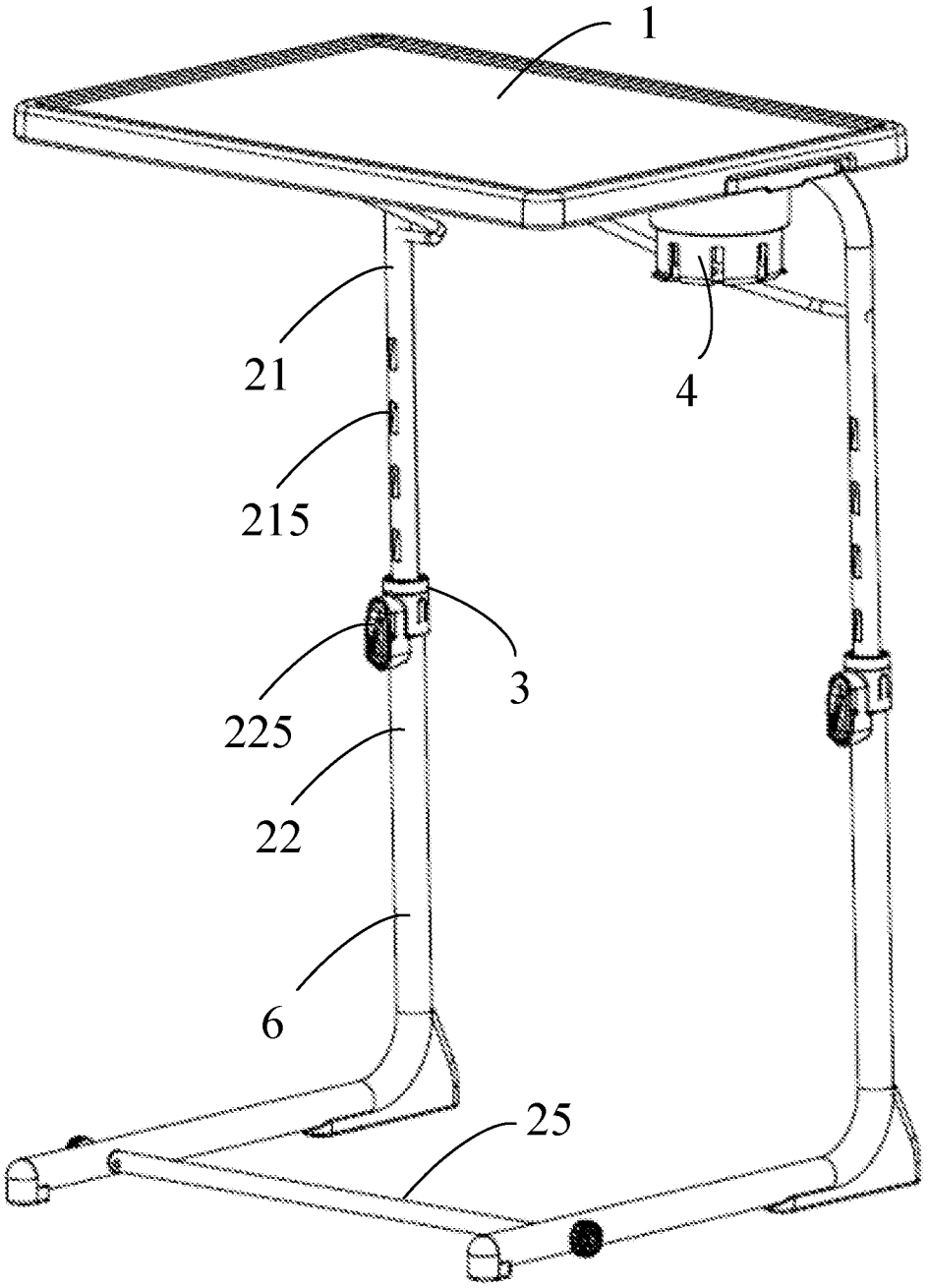
FIG. 8 is a top perspective view illustrating an exemplary table in accordance with some exemplary embodiments of the present invention.
Figure 9:
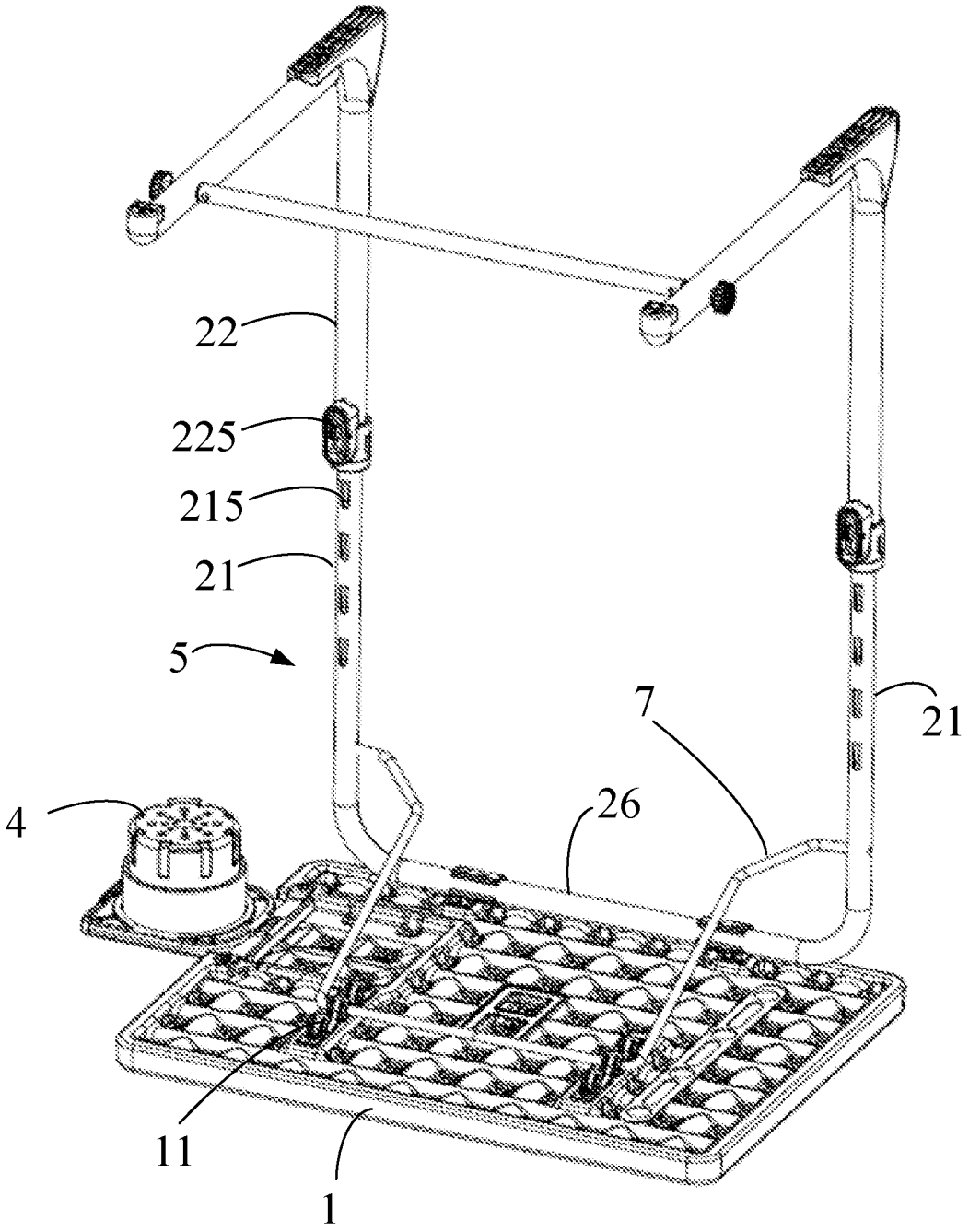
FIG. 9 is a bottom perspective view illustrating the exemplary table of FIG. 9 in accordance with some exemplary embodiments of the present invention.

In some exemplary embodiments, leg 6 is movable along support 21 and selectively lockable with support 21. For instance, in some exemplary embodiments, support 21 and first segment 22 of leg 6 are telescopically connected to each other. One of support 21 and first segment 22 includes a plurality of positioning holes and the other of support 21 and first segment 22 includes a clamping element insertable into any one of the plurality of positioning holes. As a non-limiting example, FIGS. 1 and 3-5 illustrate that first segment 22 includes a plurality of positioning holes 221 along a length direction of first segment 22, and support 21 includes a clamping element 213 insertable into any one of the plurality of positioning holes 221. As another non-limiting example, FIGS. 8 and 9 illustrate that support 21 includes a plurality of positioning holes 215 along a length direction of support 21, and first segment 22 includes a clamping element 225 insertable into any one of the plurality of positioning holes 215. The positioning holes can be disposed uniformly or nonuniformly, and the clamping element can be elastic or nonelastic. As such, the table can be placed at various different heights to meet different needs or preferences of users. It can be used in different occasions, in different places and for different purposes. This significantly improves the universality and usability of the table.

Referring to FIGS. 1 and 9, in some exemplary embodiments, first support assembly 5 further includes a lateral support, such as support 26. In some exemplary embodiments, the lateral support is rotatably connected to the tabletop at or adjacent to an edge of the tabletop. In some exemplary embodiments, the first, second and lateral supports (e.g., two supports 21 and support 26) are formed of a substantially U-shaped unitary piece.

In some exemplary embodiments, table 100 includes a second support assembly, such as second support assembly 7. The second support assembly is connected to the tabletop and the first support assembly and is configured to define the unfolded position of the tabletop with respective to the first support assembly. For instance, in some exemplary embodiments, tabletop 1 includes one or more slot sets, each having a plurality of slots 11, on an underside of the tabletop. Second support assembly 7 is configured to be selectively and removably connected to any one of the plurality of slots, thereby defining a plurality of unfolded positions of the tabletop with respective to the first support assembly.

Referring to FIGS. 1 and 7-9, in some exemplary embodiments, table 100 includes an accessory assembly, such as accessory assembly 4. The accessory assembly is slidably connected to the tabletop and movable between an extended position (illustrated in FIGS. 7 and 8) and a contracted position (illustrated in FIGS. 1 and 9) with respect to the tabletop. In some exemplary embodiments, the accessory assembly is a storage unit, for instance, configured to hold a cup and/or other items. When it is not needed, the accessory assembly can be moved inward and hidden under the tabletop. When it is needed, the accessory assembly can be moved outward to provide additional usable spaces.

The tables disclosed herein have a number of advantages. For instance, by limiting the rotation of the legs within the desired range, the tables of the present invention are more stable and more convenient to use. The tables of the present invention meet user needs and improve satisfaction. In some exemplary embodiments, the rotation of the legs are between 0°~90°. By allowing the legs to move and selectively lock with the supports, the tables of the present invention can be placed at various different heights to meet different needs or preferences of users. The tables of the present invention have improved universality and usability. They can be used in different occasions, in different places and for different purposes.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "interior" or "exterior", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first support could be termed a second support, and, similarly, a second support could be termed a first support, without changing the meaning of the description, so long as all occurrences of the "first support" are renamed consistently and all occurrences of the "second support" are renamed consistently.

What is claimed is:

1. A foldable table comprising:

a tabletop;

a first support assembly connected to the tabletop, wherein the tabletop is rotatable with respect to the first support assembly around a first axis between a folded position and an unfolded position;

a first leg connected to the first support assembly and rotatable around a second axis substantially perpendicular to the first axis between a first closed position and a first open position; and a second leg connected to the first support assembly and rotatable around a third axis substantially perpendicular to the first axis between a second closed position and a second open position, wherein the table is folded when the tabletop is in the folded position, the first leg is in the first closed position, and the second leg is in the second closed position, and the table is unfolded when the tabletop is in the unfolded position, the first leg is in the first open position, and the second leg is in the second open position; and wherein:

the first support assembly comprises a first support and a second support;

the first leg is rotatably connected to the first support;

the second leg is rotatably connected to the second support;

a first sleeve is fixed at an upper end portion of the first leg to limit rotation of the first leg relative to the first support within the first closed position and first open position; and a second sleeve is fixed at an upper end portion of the second leg to limit rotation of the second leg relative to the second support within the second closed position and second open position.

2. The foldable table of claim 1, wherein the first or second support has a substantially D-shaped cross-section.

3. A foldable table comprising:

a tabletop;

a first support assembly connected to the tabletop, wherein the tabletop is rotatable with respect to the first support assembly around a first axis between a folded position and an unfolded position;

a first leg connected to the first support assembly and rotatable around a second axis substantially perpendicular to the first axis between a first closed position and a first open position; and a second leg connected to the first support assembly and rotatable around a third axis substantially perpendicular to the first axis between a second closed position and a second open position, wherein:

the table is folded when the tabletop is in the folded position, the first leg is in the first closed position, and the second leg is in the second closed position, and the table is unfolded when the tabletop is in the unfolded position, the first leg is in the first open position, and the second leg is in the second open position;

the first support assembly comprises a first support and a second support;

the first leg is rotatably connected to the first support;

the second leg is rotatably connected to the second support;

a first limiting structure is disposed at or integrally formed with one of the first support and first leg to limit rotation of the first leg relative to the first support within the first closed position and first open position;

a second limiting structure is disposed at or integrally formed with one of the second support and second leg to limit rotation of the second leg relative to the second support within the second closed position and second open position;

a respective limiting structure in the first and second limiting structures is hollow and comprises a protrusion on an interior surface of the respective limiting structure, wherein the protrusion comprises a first limiting surface and a second limiting surface; and a corresponding support in the first and second supports or a corresponding leg in the first and second legs comprises a first exterior surface; and the first exterior surface of the corresponding support or corresponding leg abutting against the first and second limiting surfaces of the protrusion of the respective limiting structure defines corresponding closed and open positions of the corresponding leg.

4. The foldable table of claim 3, wherein the respective limiting structure is a sleeve fixed at an upper end portion of the corresponding leg.

5. The foldable table of claim 3, wherein the first and second limiting surfaces of the respective limiting structure are substantially perpendicular to each other.

6. The foldable table of claim 3, wherein the first exterior surface of the corresponding support or corresponding leg is substantially flat.

7. The foldable table of claim 3, wherein the corresponding support or corresponding leg comprises a second exterior surface, wherein the second exterior surface is an arc surface.

8. The foldable table of claim 3, wherein the corresponding support or corresponding leg has a substantially D-shaped cross-section.

9. The foldable table of claim 3, wherein:

the first support is elongated along the second axis; and the second support is elongated along the third axis.

10. The foldable table of claim 9, wherein:

a respective leg in the first and second legs is movable along a corresponding support in the first and second supports and selectively lockable at any one of a plurality of heights relative to the corresponding support.

11. The foldable table of claim 10, wherein:

one of the respective leg or the corresponding support comprises a plurality of positioning holes along a length direction of the respective leg or the corresponding support; and the other of the respective leg or the corresponding support comprises a clamping element insertable into any one of the plurality of positioning holes.

12. The foldable table of claim 3, wherein each of the first and second legs comprises a first segment and a second segment collectively forming a substantially L shape.

13. The foldable table of claim 12, wherein the second segments of the first and second legs are folded onto each other when the first leg is in the first closed position and the second leg is in the second closed position.

14. The foldable table of claim 12, wherein the second segments of the first and second legs are spaced apart and substantially parallel to each other when the first leg is in the first open position and the second leg is in the second open position.

15. The foldable table of claim 14, further comprising:

an accessory member connected to the second segments of the first and second legs to help prevent the first or second leg from rotating around the second or third axis when the table is in use, wherein the accessory member is removably connected to the second segment of the first or second leg.

16. The foldable table of claim 3, wherein the first support assembly further comprises a lateral support between the first and second supports and rotatably connected to the tabletop at or adjacent to an edge of the tabletop.

17. The foldable table of claim 3, further comprising:

a second support assembly connected to the tabletop and the first support assembly to define the unfolded position of the tabletop with respective to the first support assembly.

18. The foldable table of claim 17, wherein:

the tabletop comprises a plurality of slots on an underside of the tabletop; and the second support assembly is selectively and removably connected to any one of the plurality of slots, thereby defining a plurality of unfolded positions of the tabletop with respective to the first support assembly.

19. The foldable table of claim 3, further comprising:

an accessory assembly slidably connected to the tabletop and movable between an extended position and a contracted position with respect to the tabletop.

* * * * *